United States Patent [19]

Meinzer

[11] 4,099,818

[45] Jul. 11, 1978

[54] NON-EXPLOSIVE INITIATOR

[75] Inventor: Willy L. Meinzer, Canoga Park, Calif.

[73] Assignee: Viking Industries, Inc., Chatsworth, Calif.

[21] Appl. No.: 795,099

[22] Filed: May 9, 1977

[51] Int. Cl.[2] ..... H01R 13/62

[52] U.S. Cl. ..... 339/45 R; 24/230 AT; 285/3

[58] Field of Search ..... 339/45, 46; 285/1-3, 285/18, DIG. 21, DIG. 23; 294/83, 86.17, 86.2, 86.27, 86.29; 24/230 AT, 211 M; 89/1.811

[56] References Cited

U.S. PATENT DOCUMENTS

| | | | |
|---|---|---|---|
| 2,992,594 | 7/1961 | Anderson et al. | 24/230 AT |
| 3,146,846 | 9/1964 | Gutshall | 24/230 AT |
| 3,159,444 | 12/1964 | Stine, Jr. | 339/45 M |
| 3,323,814 | 6/1967 | Phillips | 339/45 R |

FOREIGN PATENT DOCUMENTS

| | | | |
|---|---|---|---|
| 2,060,789 | 6/1972 | Fed. Rep. of Germany | 24/230 AT |

*Primary Examiner*—Neil Abrams

*Attorney, Agent, or Firm*—Ellsworth R. Roston

[57] ABSTRACT

Movement of a first output member is initiated relative to a second member on a non-explosive basis. A wire holds a pair of members in a first relationship until disintegrated by electrical current. The first members retain a second member in a first relationship until the wire is disintegrated. The second member is biased for movement to a second relationship when the wire disintegrates. A third pair of members is biased to retain a fourth member in a frictional relationship. The fourth member is coupled to the first output member to move the first output member. The third member is moved by the second member out of frictional relationship with the fourth member. The fourth member is biased to move the first output member when the fourth member is released by the third member. The wire and the first through fourth members are disposed in retention means so that the first and second means and the wire can be withdrawn from the retention means, or inserted into the retention means in their first relationships, without affecting the disposition in the retention means of the third and fourth members in the first relationships.

22 Claims, 5 Drawing Figures

NON-EXPLOSIVE INITIATOR

This invention relates to apparatus for initiating a movement of one output member relative to another. The apparatus is especially advantageous because it initiates such a movement by energizing an element in the apparatus on a static, non-explosive and non-pyrotechnic basis.

In many applications, a first output member is retained in a particular relationship relative to a second output member and is moved at some predetermined time to a second relationship with the second output member. For example, an electrical connector may be formed from male and female members. When the male member has entered the female member, electrical continuity is established through the connector. At some predetermined time, however, the male member has to be moved out of engagement with the female member so that electrical continuity through the connector becomes discontinued.

There are many satisfactory techniques for moving the two output members (e.g., the male and female members of a connector) from the first relationship to the second relationship. All of such techniques have involved the use of parts which have had to be dynamically moved by a driving member.

Sometimes the first output member has to be moved relative to the second output member by the initiation of a static occurrence rather than a dynamic occurrence. For example, this has been sometimes dictated by space requirements. At other times, it has been dictated by the requirements of simplicity in design or by the requirements of foolproof actuation of one of the output members relative to the other.

A considerable effort has been devoted in the prior art to provide an arrangement which can move a first output member relative to a second output member by the initiation of a static reaction. Such attempts have not been entirely successful, particularly when the static reactions have had to occur on a non-explosive and non-pyrotechnic basis. For example, when the output members constitute the male and female portions of a connector, the connector has sometimes been used in explosive environments such as in rockets or missiles. Under such circumstances, the initiation of the movement of the first output member relative to the second output member by an explosive or pyrotechnic reaction has been dangerous because there has been the inherent possibility that the fuels in the rockets or the missiles would be ignited by the explosion.

This invention provides an arrangement for initiating a movement of a first output member relative to a second output member by a static and non-explosive and non-pyrotechnic arrangement. In this arrangement, the movement of the first output member is initiated by the passage of an electrical current through a wire having the properties of being disintegrated by the current. Before disintegration, the wire is wound on a first pair of members to retain the members in closely coupled relationship. The members in turn prevent the movement of a second member which is biased for movement in a particular direction. When the wire becomes disintegrated, the second member is able to overcome the opposition of the first pair of members and to move in the particular direction.

A third pair of members is spring biased to retain a fourth member in a frictional relationship so that the fourth member cannot be moved. The fourth member is operatively coupled to the first output member to move the first output member in accordance with the movement of the fourth member.

The third pair of members is moved by the second member to a position out of frictional relationship with the fourth member when the wire is disintegrated. The fourth member is spring biased to provide for a movement of the fourth member and the first output member when the fourth member is released from its frictional engagement with the third pair of members.

Figure 1:
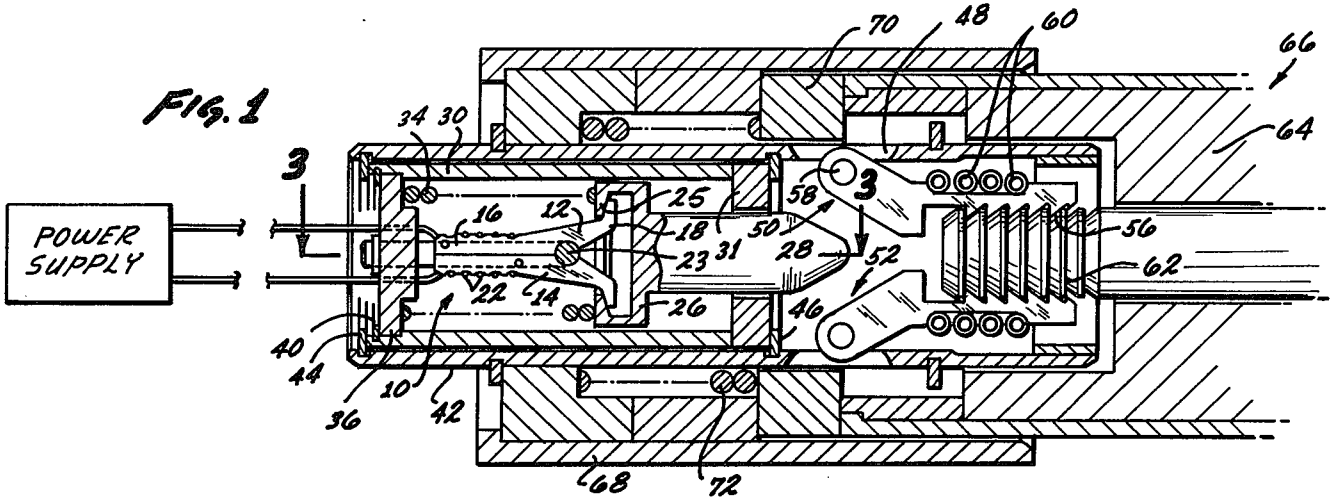
FIG. 1 is a sectional view of one embodiment of the invention when the different components in the embodiment are assembled and ready for operation.

The embodiment shown in the drawings includes a plunger generally indicated at 10 and formed from a pair of members 12 and 14 having a similar construction and having a symmetrical arrangement. The member 12 is formed from a collar portion 16 and an arm 18 extending from the collar portion 16 in a transverse relationship. The plunger 16 is provided with a plurality of sockets 20 for receiving the turns of a wire 22. The member 14 is provided with an arrangement similar to the member 12.

Figure 2:
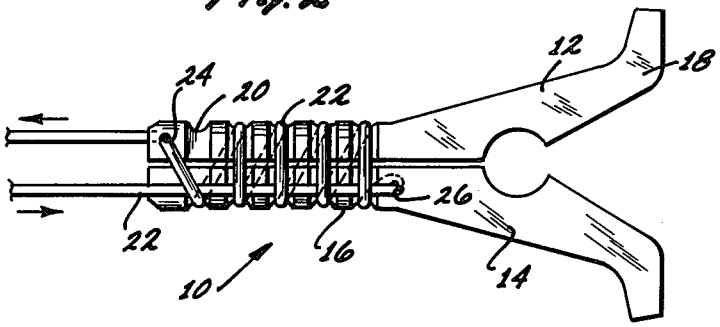
FIG. 2 is an enlarged view of particular components in the embodiment shown in FIG. 1 and particularly shows a winding disposed on a pair of jaws and having properties of retaining the jaws in abutting relationship and of becoming disintegrated to free the jaws when current is passed through the wire.
Figure 5:
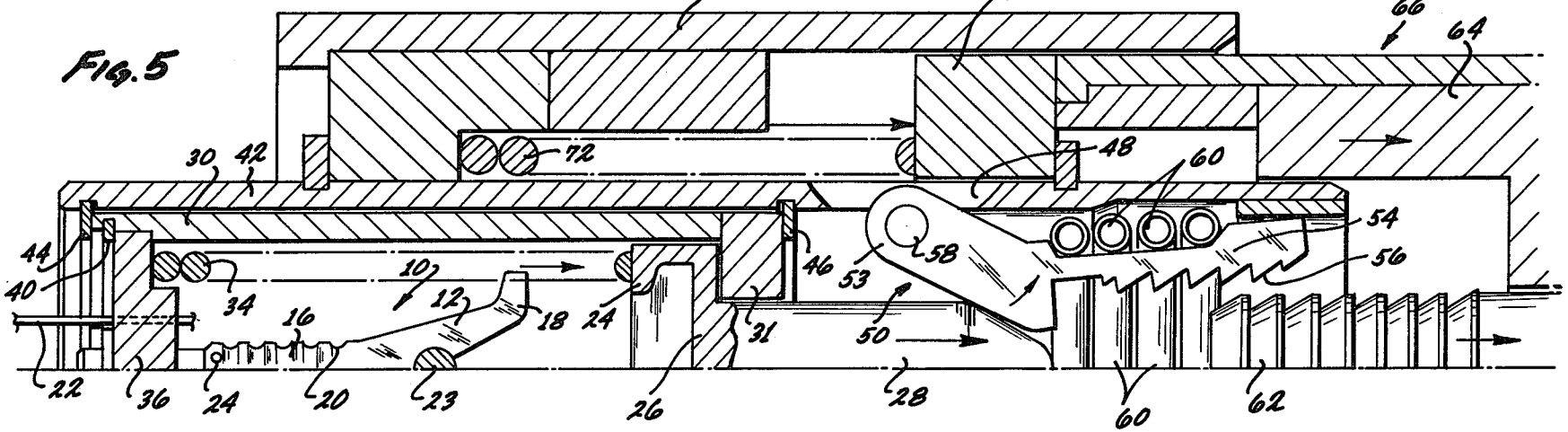
FIG. 5 is a fragmentary sectional view similar to that of FIG. 4 but showing the different components after the wire has become disintegrated and the embodiment has been fully actuated.

As shown in FIG. 2, the wire 22 is inserted through a hole 26 at one end of the collar portion 16 in the member 14. The wire 22 is then wound upon the members 12 and 14 in a helical arrangement for disposition in the sockets such as the sockets 22 and is then fed through a hole 24 at the other end of the collar portion on the member 12. The free ends of the wire 22 extend outwardly to a position external to the apparatus shown in the drawings. In this way, the ends of the wire can be connected to an external circuit for energizing the wire.

The wire 22 is made from a suitable bimetallic composition so that the wire will disintegrate when current is passed through it. For example, the wire may be purchased from the Pyrofuze Corporation of Mount Vernon, New York, under the trademark designation of "PYROFUZE" braid. Such wire has the properties of becoming disintegrated by the passage of an electrical current without being pyrotechnic or explosive.

A pivot pin 23 is disposed between the members 12 and 14 at a position where the arms extend outwardly from the collar portions. The arm 18 of the member 12 and the corresponding arm of the member 14 are disposed against an internal flange 24 of a plunger 26 to retain the plunger against movement in a direction toward the right in FIG. 1 during the time that the wire 22 retains the collars on the members 12 and 14 in abutting relationship. The plunger 26 has a tongue 28 which projects forwardly from the plunger. The tongue 28 has inclined surfaces at its forward end.

The plunger 26 is disposed in a cartridge 30 which is provided with an inwardly turned flange 31 at one end. The plunger 26 is biased by a spring 34 for movement toward the right in FIG. 1. The spring is disposed in a constrained relationship between inwardly turned flange 25 and a disc 36 disposed at the left end of the cartridge. The disc 36 is retained in fixed position relative to the cartridge 30 by a ring 40. When the disc 36 is removed, electrical connections may be made to the wire 23.

The cartridge 30 is disposed in retention means such as a sleeve 42. A pair of rings 44 and 46 are provided in the retention means such as the sleeve 42 at spaced positions to retain the cartridge 30 in a fixed relationship within the sleeve. When the ring 44 is removed, a new cartridge 30 may be substituted for the cartridge previously in the assembly. With the new cartridge 30 may be included a new plunger 10, spring 34 and plunger 26. By providing for such a replacement, a new firing assembly may be substituted when the previous one has been actuated by passing current through the wire 23.

The retention means such as the sleeve 42 is provided with a pair of apertures 48 to receive a pair of split nuts generally indicated at 50 and 52. The split nut 50 is formed from an arm 53 extending in a transverse direction and from a collar portion 54 internally threaded as at 56. The slope of the arm 53 corresponds to the slope of the tongue 28 at the forward end of the tongue. A pivot pin 58 extends through the arm 53 near the end of the arm removed from the collar portion 54. The split nut 52 is constructed in a manner similar to the split nut 50.

A plurality of springs 60 are disposed in a recessed portion on the external surface of the collar portion 54 of the split nut 50 and on a similarly disposed recessed portion on the external surface of the collar portion on the split nut 52. Each of the springs 60 is preferably formed from a single turn. The springs 60 act to bias the collar portions of the split nuts 50 and 52 against an externally threaded screw 62 to maintain the threads on the screw 62 in frictional relationship with the threads 56 on the split nut 50 and with similar threads on the split nut 52 so that the screw cannot be moved relative to the split nuts. In effect, the threads on the members 50 and 52 and the threads on the screw provide a detent relationship for restraining the movement of the screw.

The screw 62 is connected to the male member 64 of an electrical connector generally indicated at 66. The connector 66 also includes a female member 68. The electrical connector is constructed in a conventional manner so that the male member 64 and the female member 68 become coupled to one another in one operative relationship to provide electrical continuity through one or more terminals in the connector. The male member 64 is movable to a second position relative to the female member 68 such that electrical continuity is no longer established through the terminals in the connector.

A plug 70 is disposed on the sleeve 42 between the male and female members of the connector 66. The plug 70 is provided with an internal recess to retain a spring 72 under compression between the plug 70 and a wall formed by a recess in the female member 68.

The above-described operation also serves the purpose of disengaging the electrical contacts to discontinue electrical current ahead of the separation of the male 66 and the female 68 connector to avoid sparks arcing between the contacts which otherwise may occur.

The members are normally disposed in their relationship shown in FIGS. 1 and 2. In this relationship, the wire 22 retains the collar portions of the members 12 and 14 in abutting relationship so that the arm 18 of the member 12 and the corresponding arm of the member 14 are disposed against the internal flange of the plunger 26 to prevent the plunger from being moved by the spring 34 toward the right in FIG. 1.

In the operative relationship of FIG. 1, the springs 60 bias the collar portion 54 of the split nut 50 and the corresponding collar on the split nut 52 to engage the threads on the screw 62 in a frictional relationship such that the screw 62, the male member 64 of the connector 65 and the plug 70 cannot be moved to the right by the spring 72.

Figure 4:
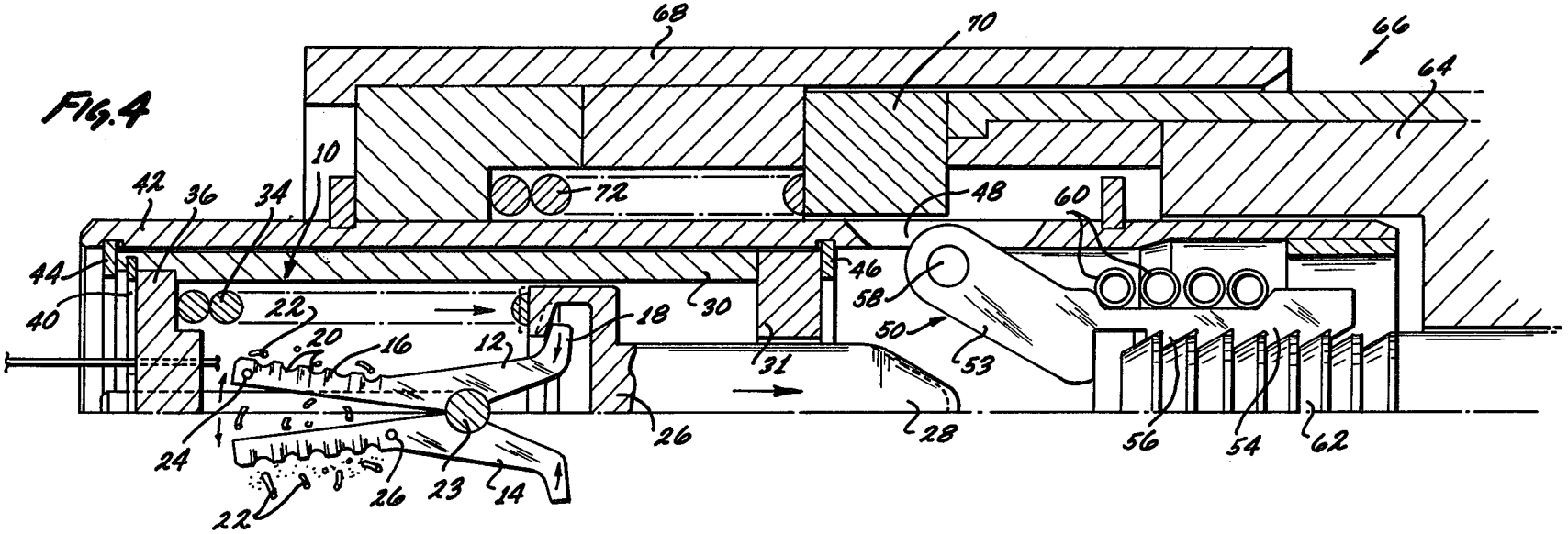
FIG. 4 is an enlarged fragmentary sectional view of the embodiment shown in FIG. 1, with the members in a relationship immediately after actuation by the disintegration of the wire shown in FIG. 2.
Figure 3:
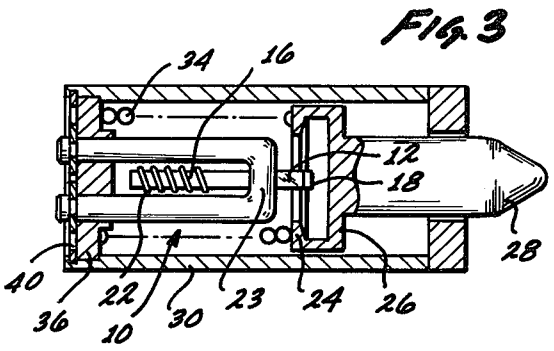
FIG. 3 is a sectional view substantially on the line 3—3 of FIG. 1.

When it is desired to actuate the unit described above, current is passed through the wire 22 to disintegrate the wire. This frees the arm 18 of the member 12 and the corresponding arm of the member 14 for pivotable movement about the pivot pin 23. As a result, the spring 34 is able to drive the plunger 26 toward the right in FIG. 1. This may be seen by a comparison of the positions of the plunger 26 and the tongue 28 in solid and broken lines in FIG. 4. The movement of the plunger 26 is limited by the internal flange 31 on the cartridge 30.

When the plunger 26 has moved a sufficient distance toward the right in FIG. 1, the inclined surfaces on the tongue 28 engage the similarly inclined surfaces on the arm 53 of the split nut 50 and the corresponding arm of the split nut 52 and pivots these arms on their associated pivot pin against the bias imposed by the springs 60. This causes the threads 56 on the collar portion 54 of the split nut 50 and the corresponding threads on the collar portion of the split nut 52 to be pivoted from engagement with the threads on the screw 62 so that the screw is free for movement toward the right. The spring 72 then drives the male member 64 of the connector 66 and the screw 62 toward the right in FIG. 1 so that the male member becomes disconnected from the female member 68.

The apparatus described above has certain important advantages. It provides a positive and reliable operation of an output member such as the male member 64 of the connector 66. Furthermore, it provides this operation by the disintegration of the wire 22 in a non-pyrotechnic and non-explosive manner. Since the wire 22 initiates the actuation of the output member, actuation is initiated on a static basis rather than on a dynamic basis, such as the movement of a driving member, as in the prior art. The apparatus constituting this invention is also compact and employs a minimal number of parts.

Although this application has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination for providing a movement of a first output member relative to a second output member, a sleeve, a wire having properties of disintegrating upon the application of an electrical current, means operatively coupled to the wire for applying an electrical current to the wire to disintegrate the wire, first means disposed within the sleeve and cooperative with the wire in a first position for restraint by the wire against movement to a second position and biased for movement to the second position upon release by the wire, second means disposed within the sleeve and biased against movement by the first means in the first position and disposed relative to the first means for movement in a particular direction upon the movement of the first means to the second position, third means disposed within the sleeve relative to the first means and the second means for providing for the insertion of the first means and the second means and the wire into the sleeve with the wire biasing the first means to the first position and for providing for the withdrawal of the first means and the second means and the wire from the sleeve, fourth means disposed within the sleeve and restrained against movement during the biasing of the second means against movement in the particular direction and released for movement by the second means in accordance with the movement of the second means in the particular direction, and fifth means disposed within the sleeve and cooperative with the fourth means and biased for movement in the particular direction, upon the release of the fourth means for movement, and disposed in cooperative relationship with the first output member to obtain a movement of the first output member in the particular direction relative to the second output member.

2. The combination set forth in claim 1 wherein the first means includes sixth means restrained by the wire and released, upon the disintegration of the wire, for pivotal movement and the second means includes seventh means normally restrained by the sixth means against movement and biased for movement in the particular direction and responsive to the pivotal movement of the sixth means for providing a movement in the particular direction.

3. The combination set forth in claim 1 wherein the second means includes a plunger movable in the particular direction and the first means includes a pair of pivotable arms engageable by the plunger for pivotal movement upon the movement of the plunger in the particular direction and the second means further includes means for biasing the plunger to obtain a movement of the plunger in the particular direction and the fourth means includes means disposed in frictional relationship with the fifth means, before pivotable movement of the arms, for preventing movement of the fifth means in the particular direction and for providing for such movement of the fifth means in the particular direction upon the pivotable movement of the arms.

4. The combination set forth in claim 3 wherein the means in the fourth means providing the frictional relationship with the fifth means is threaded and the fifth means includes a threaded member disposed in cooperative relationship with the means in the fourth means providing the frictional relationship.

5. The combination set forth in claim 4 wherein the fourth means includes a plug operatively coupled to the first output member and a spring disposed in constrained relationship against the plug and responsive to the release of the fourth means by the second means for moving the plug in the particular direction.

6. In combination for providing a movement of a first output member relative to a second output member, retention means, a wire disposed within the retention means and having properties of disintegrating upon the application of a current to the wire, means for providing for a passage of a current through the wire to disintegrate the wire, first means disposed within the retention means and having first and second relationships and retained by the wire in the first relationship and biased for displacement to the second relationship upon the disintegration of the wire, second means disposed within the retention means and having first and second relationships and retained by the first means in the first relationship with the first means in the first relationship and biased for displacement to the second relationship upon the displacement of the first means to the second relationship, third means disposed within the retention means and having first and second relationships and biased in the first relationship and responsive to the movement of the second means to the second relationship for movement to the second relationship, and fourth means disposed within the retention means and having first and second relationships and responsive to the disposition of the third means in the first relationship for disposition in the first relationship and biased for displacement to the second relationship upon the displacement of the third means to the second relationship, the fourth means being operatively coupled to the first output member for displacement of the first output member relative to the second output member in accordance with the displacement of the fourth means from the first relationship to the second relationship, the first means and the second means and the wire having, in the first relationships of the first means and the second means, a cooperative relationship with respect to one another and a decoupled relationship from the third means and the fourth means to provide for a removal of the first means and the second means and the wire from the retention means without disturbing the third means and the fourth means in the first relationships of the third means and the fourth means.

7. The combination set forth in claim 6 wherein the second means includes a plunger having flange portions disposed in cooperative relationship with the first means for constraining the second means against movement from the first relationship to the second relationship during the disposition of the first means in the first relationship and further includes a spring biasing the plunger for movement from the first relationship to the second relationship and wherein the flange portions on the plunger are constrained by the spring to produce a movement of the first means to the second relationship when the wire is disintegrated.

8. The combination set forth in claim 6 wherein the third means includes a pair of members having a pair of arms and a pair of detent portions respectively extending from the arms and the pair of detent portions engage the fourth means in a frictional relationship to prevent any movement of the fourth means in the first relationship of the third means and a spring biases the detent portions of the pair of members to the first relationship.

9. The combination set forth in claim 6 wherein the third means include a pair of members having threaded portions and the fourth means includes a member having a threaded portion and disposed between the pair of members in frictional relationship to the pair of members in the first relationship and wherein the third means is biased to the first relationship and wherein the second means moves the third means to the second relationship and wherein the fourth means includes a plug and the member having the threaded portion in the fourth means is operatively coupled to the plug and a spring biases the plug for displacement of the fourth means to the second relationship.

10. In combination, first means pivotable between first and second relationships, a wire maintaining the first means in the first relationship and having properties of passing an electrical current and of disintegrating upon the passage of such current, means for providing for the passage of an electrical currents through the wire, second means movable in a particular direction between first and second relationships and restrained in the first relationship by engagement with the first means in the first relationship and biased for movement to the second relationship and for pivotable movement of the first means to the second relationship, third means pivotable between first and second relationships and biased to the first relationship and decoupled from the second means in the first relationships of the second and third means and responsive to movement of the second means to the second relationship for pivotable movement by the second means to the second relationship, fourth means movable in the particular direction between first and second relationships and restrained in the first relationship by the third means in the first relationship and biased for movement in the particular direction to the second relationship in response to movement of the third means to the second relationship, a first output member, a second output member having first and second operative relationships with respect to the first output member and normally disposed in the first operative relationship and responsive to movement of the fourth means to the second relationship for movement to the second operative relationship, and retention means holding the first, second, third and fourth means and the wire relative to one another to provide for the removal of the first and second means and the wire from the retention means without affecting the disposition of the third and fourth means in the first relationship and to provide for the insertion of the first and second means and the wire into the retention means in their first relationship without affecting the disposition of the third and fourth means in the first relationship.

11. The combination set forth in claim 10 wherein the first output member constitutes the female member in an electrical connector and the second output member constitutes the male member in an electrical connector.

12. The combination set forth in claim 11 wherein the third means includes a pair of members, each having an arm and a detent portion, and wherein pivot pins extend through the arms to provide for pivotal movement of the members and spring means bias the detent portions toward each other in the first relationship of the third means and the fourth means include a friction member disposed between the detent portions for frictional engagement by the detent portions in the first relationship of the third means.

13. The combination set forth in claim 12 wherein the fourth means includes a drive member movable with the friction member and wherein spring means biases the drive member for movement to the second relationship of the fourth means and the second output member is movable with the drive member.

14. The combination set forth in claim 12 wherein the second means include a plunger having a flange engaged by the first means with the wire disposed on the first means and further include a tongue for engaging the arms on the members in the third means for driving the members when the second means is moved in the particular direction and further include spring means biasing the plunger for movement in the particular direction when the wire is disintegrated to free the arms of the first and second members for movement.

15. In combination for providing a movement of a first output member relative to a second output member, a wire having properties of disintegrating upon the application of an electrical current, first means cooperative with the wire for being restrained by the wire against movement and biased for movement upon release by the wire, second means biased against movement by the first means in the first position and disposed relative to the first means for movement in a particular direction upon the movement of the first means, third means restrained against movement during the biasing of the second means against movement and released for movement by the second means in accordance with the movement of the second means, and fourth means cooperative with the third means and biased for movement in the particular direction, upon the release of the third means for movement, and disposed in cooperative relationship with the first output member to obtain a movement of the first output member in the particular direction relative to the second output member, fifth means restrained by the wire and released, upon the disintegration of the wire, for pivotal movement and the second means includes sixth means normally restrained by the fifth means against movement and biased for movement in the particular direction and responsive to the pivotal movement of the fifth means for providing a movement in the particular direction, the fifth means including a pair of collar portions retained in closely coupled relationship by the wire and a pair of arms respectively extending outwardly from the collar portions and a pin on which the arms are mounted for pivotal movement upon the disintegration of the wire and the sixth means including a plunger having inwardly turned lips for retention by the arms before pivotal movement of the arms in the fifth means and further including a spring constrained to produce a movement of the plunger in the particular direction upon a pivotal movement of the arms.

16. In combination for providing a movement of a first output member relative to a second output member, a wire having properties of disintegrating upon the application of a current to the wire, first means having first and second relationships and retained by the wire in the first relationship and biased for displacement to the second relationship upon the disintegration of the wire, second means having first and second relationships and retained by the first means in the first relationship with the first means in the first relationship and biased for displacement to the second relationship upon the displacement of the first means to the second relationship, third means having first and second relationships and biased in the first relationship and responsive to the movement of the second means to the second relationship for movement to the second relationship, fourth means having first and second relationships and responsive to the disposition of the third means in the first relationship for disposition in the first relationship and biased for displacement to the second relationship upon the displacement of the third means to the second relationship, the fourth means being operatively coupled to the first output member for displacement of the first output member relative to the second output member in accordance with the displacement of the fourth means from the first relationship to the second relationship, the first means including a pair of members each having an arm and a collar, and the wire being wound on the collars to retain the collars in abutting relationship until the disintegration of the wire, and a pivot pin in cooperative relationship with the arms to provide for a pivotable displacement of the arms and a spring disposed in constrained relationship for pivoting the arms when the wire is disintegrated.

17. The combination set forth in claim 16 wherein the second means includes a plunger having a flange portion engaging the arms on the pair of members for constraining the second means against movement during the disposition of the first means in the first relationship and the spring is disposed in constrained relationship against the flange portion on the plunger.

18. The combination set forth in claim 17 wherein the plunger has a tongue and the third means includes a pair of members having a pair of arms and a pair of detent portions respectively extending from the arms and the pair of members are pivotable about pivot pins operating as a fulcrum and extending through the arms and wherein the tongue is movable in the operative relationship of the second means to a position for pivoting the arms and wherein a spring biases the detent portions to the first relationship of the third means and wherein the pair of detent portions engage the fourth means in a frictional relationship to prevent any movement of the fourth means.

19. The combination set forth in claim 17 wherein the third means include a pair of members having threaded portions and a pair of arms respectively extending from the threaded portions and further include pivot pins extending through the arms to provide for pivotal movement of the arms and wherein a spring biases the threaded portions to the first relationship and the plunger engages the arms to pivot the arms to the second relationship of the third means and the fourth means includes a threaded member engageable by the threaded portions of the arms in the third means in the first relationship of the third means and the fourth means includes a plug movable with the threaded member and a spring biases the plug for displacement of the fourth means to the second relationship.

20. In combination, first means pivotable between first and second relationships, a wire maintaining the first means in the first relationship and having properties of passing an electrical current and of disintegrating upon the passage of such current, second means movable in a particular direction between first and second positions and restrained in the first position by engagement with the first means in the first relationship and biased for movement to the second relationship and for pivotable movement of the first means to the second relationship, third means pivotable between first and second relationship and biased to the first relationship and responsive to movement of the second means to the second relationship for pivotable movement to the second relationship, fourth means movable in the particular direction between first and second relationships and restrained in the first relationship by the third means in the first relationship and biased for movement in the particular direction to the second relationship in response to movement of the third means to the second relationship, a first output member, and a second output member having first and second operative relationships with respect to the first output member and normally disposed in the first operative relationship and responsive to movement of the fourth means to the second relationship for movement to the second operative relationship, the first means including a plunger formed from first and second members each having a collar portion and an arm extending in a transverse direction from the collar portion and further including a pivot pin providing for a pivotable movement of the first and second members and the arms being disposed relative to the second means to restrain the second means when the collar portions of the first and second members are disposed in abutting relationship and the wire being disposed on the collar portions to maintain the collar portions in abutting relationship.

21. The combination set forth in claim 20 wherein the second means include a plunger having a flange disposed against the arms of the first and second members for moving the arms and further include spring means biasing the plunger for movement when the wire is disintegrated to free the arms of the first and second members for movement.

22. In combination, first means pivotable between first and second relationships, a wire maintaining the first means in the first relationship and having properties of passing an electrical current and of disintegrating upon the passage of such current, second means movable in a particular direction between first and second positions and restrained in the first position by engagement with the first means in the first relationship and biased for movement to the second relationship and for pivotable movement of the first means to the second relationship, third means pivotable between first and second relationship and biased to the first relationship and responsive to movement of the second means to the second relationship for pivotable movement to the second relationship, fourth means movable in the particular direction between first and second relationships and restrained in the first relationship by the third means in the first relationship and biased for movement in the particular direction to the second relationship in response to movement of the third means to the second relationship, a first output member, and a second output member having first and second operative relationships with respect to the first output member and normally disposed in the first operative relationship and responsive to movement of the fourth means to the second relationship for movement to the second operative relationship, the third means including a pair of members, each having an arm and a detent portion, and pivot pins extending through the arms to provide for pivotal movement of the members and spring means biasing the detent portions toward each other in the first relationship of the third means and the fourth means including a friction member disposed between the detent portions for frictional engagement by the detent portions in the first relationship of the third means, the second means including a plunger having a flange engaged by the first means with the wire disposed on the first means and further including a tongue for engaging the arms on the members in the third means for driving the members when the second means is moved in the particular direction and further including spring means biasing the plunger for movement in the particular direction when the wire is disintegrated to free the arms of the first and second members for movement, the first means including a plunger formed from first and second members each having a collar portion and an arm extending in a transverse direction from the collar portion and the first means further including a pivot pin providing for a pivotable movement of the first and second members and the arms being disposed relative to the flange on the plunger to restrain the second means when the collar portions of the first and second members are disposed in abutting relationship and the wire being disposed on the collar portions to maintain the collar portions in abutting relationship.

* * * * *